US006899322B2

(12) United States Patent
Sadykhov

(10) Patent No.: US 6,899,322 B2
(45) Date of Patent: May 31, 2005

(54) METHOD AND APPARATUS FOR PRODUCTION OF DROPLETS

(75) Inventor: Akper Sadykhov, Kiriat Mozkin (IL)

(73) Assignee: Ultrasonic Dryer Ltd., Migdal Ha-Emek (IL)

( * ) Notice: Subject to any disclaimer, the term of this patent is extended or adjusted under 35 U.S.C. 154(b) by 0 days.

(21) Appl. No.: 10/466,489

(22) PCT Filed: Dec. 31, 2001

(86) PCT No.: PCT/IL01/01217

§ 371 (c)(1),
(2), (4) Date: Jul. 17, 2003

(87) PCT Pub. No.: WO02/056988

PCT Pub. Date: Jul. 25, 2002

(65) Prior Publication Data

US 2004/0113292 A1 Jun. 17, 2004

Related U.S. Application Data

(60) Provisional application No. 60/262,032, filed on Jan. 18, 2001.

(51) Int. Cl.[7] ..... B01F 3/04

(52) U.S. Cl. ..... 261/78.2; 261/102; 261/105; 261/DIG. 25; 261/DIG. 65

(58) Field of Search ..... 261/101, 102, 261/103, 78.2, 100, 105–107, 112.1, 113, DIG. 25, DIG. 65

(56) References Cited

U.S. PATENT DOCUMENTS

| | | | | |
|---|---|---|---|---|
| 1,023,063 A | * | 4/1912 | Bassford | 160/44 |
| 1,132,679 A | * | 3/1915 | Murray et al. | 423/243.08 |
| 3,583,635 A | | 6/1971 | Lemelson | |
| 4,757,812 A | | 7/1988 | Arborelius, Jr. | |
| 4,941,618 A | | 7/1990 | Hildebrand et al. | |
| 5,030,390 A | | 7/1991 | Nicholls et al. | |
| 5,431,345 A | | 7/1995 | Lund et al. | |
| 5,535,989 A | | 7/1996 | Sen | |
| 5,858,313 A | | 1/1999 | Park et al. | |
| 6,168,140 B1 | | 1/2001 | Akazawa | |
| 6,315,272 B1 | * | 11/2001 | Stanek et al. | 261/23.1 |
| 6,527,257 B1 | * | 3/2003 | Schuld | 261/29 |

FOREIGN PATENT DOCUMENTS

| | | |
|---|---|---|
| EP | 0135 390 | 9/1984 |
| FR | 1 031 185 | 1/1951 |
| FR | 1 473 399 | 3/1966 |
| WO | WO 00/58022 | 3/2000 |

OTHER PUBLICATIONS

International Search Report, mailed Jul. 18, 2002.

"The Fundementals of the Ultra–Sonic Atomization of Medicated Solutions," R.M.G. Boucher, Ph.D. and J. Kreuter, Annals of Allergy, vol. 26, Nov. 1968, pp. 591–600.

* cited by examiner

*Primary Examiner*—Scott Bushey
(74) *Attorney, Agent, or Firm*—Blank Rome LLP

(57) ABSTRACT

The invention concerns a method and apparatus (100) for producing mist of a liquid phase having very fine and mono-dispersed droplets. The method is realized by an apparatus (100) including a partition (101), defined by a first side surface (107) and a second side surface (113). The first side surface (107) is wetted by a liquid phase to form a film thereon, while the second side surface (113) is substantially dry. A gas stream is directed through the partition (101) from the dry side (113) to the wetted side (107) thereby forming a mist having droplets of less than 1 micron in size and a concentration of at least 1,000,000,000,000 per cubic cm.

20 Claims, 5 Drawing Sheets

METHOD AND APPARATUS FOR PRODUCTION OF DROPLETS

This application claims the benefit of prov. application No. 60/262,032 filed on Jan. 18, 2001.

BACKGROUND OF THE INVENTION

1. Field of the Invention

The present invention relates to the field of liquid atomization and in particular to the large-scale production of ultra-fine, homogenous liquid droplets or aerosols, emerging with low velocity.

The invention is also related to an apparatus for large-scale production of a mist, consisting of ultra-fine homogenous liquid droplets or aerosols, which employs the above method of liquid atomization.

2. Description of the Prior Art

In the further description the terms atomization and atomizer refer to the process and device, in which is achieved complete destruction of a jet of an incompressible liquid and a mist, consisting of poly-disperse drops is produced. The apparatuses, employing atomization for producing of ultra-fine droplets are known in the art as nebulizers.

There are known various methods and devices for liquid atomization and below are listed those, which have been used as a basis for devising a great variety of atomizers used in industry and described in many literature sources. The known in the art atomization devices include:

1. Centrifugal mechanical nozzles;
2. Pneumatic nozzles;
3. Centrifugal disk atomizers;
4. Ultrasonic atomizers, The drops, produced by known in the art atomizing devices usually feature a wide size distribution (polidisperse droplets), which practically excludes their applicability in nebulisers, which are dedicated devices for producing of ultra-fine and monodispersed droplets, having narrow size distribution.

Despite there are known some attempts to overcome this major shortcoming, nevertheless, these attempts do not eliminate some other deficiencies inherent to the above-mentioned atomizing devices. Below these deficiencies are listed.

In the case of mechanical nozzles

Necessity in high pressure (50–200 atm) of liquid delivered to the nozzle;

Impossibility to adjust nozzle capacity and to ensure quality of dispersion during spraying;

Small outlet size (about 0.5 mm), which makes it sensitive to contamination by liquid additives and causes rapid clogging thereof;

Wear of the nozzle outlet due to erosion, which changes capacity and dispersity of spray 2. In the case of pneumatic nozzles:

Necessity in high gas pressure (4–7 atmospheres), which causes higher velocity of emerging droplets;

Danger of contamination due to the small outlet diameter (0.2–0.4 mm), or due to strict tolerance for the dimension of the outlet slit for compressed gas;

High consumption of the compressed gas per mass unit of sprayed liquid;

Impossibility to control droplets size and quantity for a specific nozzle design.

3. In the case of disk atomizers:

High cost of the spraying device;

Necessity of careful maintenance, including greasing and monitoring of disk condition;

Danger of imbalance due to high disk rotation speed (20,000 rev/min and above) causing thermal expansion of disk material and, as a result, larger outlet dimensions;

High velocity of emerging droplets (140 m/sec and more), resulting in a larger distance of flight and thus larger diameter of spray;

Ventilation effect due to high disk rotation velocity, which creates low pressure above the disk and affects the configuration of the spray and the flight distance of the droplets;

Impossibility to control the droplets size and their amount at a given disk diameter and rotation speed.

4. In the case of ultrasonic sprayers:

High cost of device;

Low reliability;

Strong dependence on viscosity and surface tension of the sprayed liquid;

Liquid heating, which affects its properties and, therefore, may not always be permitted;

Limited capacity.

Some other solutions have been developed to improve the monodispersity of atomization achieved in pneumatic sprayers for example by virtue of disposing a filtering element in the path of a high-pressure gas-liquid flow. This filtering element comprises either a set of nets U.S. Pat. No. (4,941,618), (U.S. Pat. No. 5,431,345), or a thick glass filter (U.S. Pat. No. 5,858,313) or tiny balls arranged in a certain pattern (EP 135390).

Nevertheless, all these solutions failed to overcome such disadvantages as contamination, reduced performance, subsequent clogging up of the outlets and an undesirable high velocity of droplets.

In U.S. Pat. No. 4,757,812, the role of a rotating disk sprayer has been considerably amended by ruling out disk rotation. At the same time, the spray formation procedure remained similar to that of rotating sprayers. Due to the use of compressed air, the sprayer of this invention is closer to pneumatic sprayers. Droplet size, achieved in the device, disclosed in the above patent usually amounts to 2–6 $\mu$m and more.

According to a paper "The fundamentals of the ultrasonic atomization of medicated solutions", R.M.G., Annals of allergy, 1968, 591–600, a high-speed air flow was introduced into the vessel to suppress large drops, resulting from the operation of a high frequency ultrasonic sprayer. This air flow pushes the large drops back into the bath, allowing only the fine drops (1.5–3 $\mu$m) into the outlet nozzle. However, the amount of fine droplets reduces as compared to their amount in the spray of a high frequency ultrasonic sprayer operating without high-speed air flow.

Thus despite the existence of numerous atomizing devices there is still a need for a new method and device for producing of small droplets, in which the disadvantages of the prior art atomizers are sufficiently reduced or overcome.

OBJECTS OF THE INVENTION

The main object of the present invention is to provide a new and improved device for atomizing of liquids to form a bulk a mist, consisting of plurality of ultra-fine submicrone monodisperse low-speed liquid droplets.

Still further object of the invention is to provide a new and improved method and device for atomizing of liquids, in which it is possible to produce large amount of ultra-fine droplets, emerging with low velocity and in which it is possible to control the atomization performance without deteriorating the droplets size distribution.

Another object of the invention is to provide a new and improved device for atomizing of liquids, which is suitable for use as nebulizer, which is simple in operation, which is inexpensive and which operates reliably without clogging.

SUMMARY OF THE INVENTION

The atomizing device of invention can be attributed as a pneumatic sprayer. Due to the low travel velocity of droplets emerging from the device it combines the advantages of ultrasonic sprayers, however in contrast to them, it does not heat the atomizing liquid, but cools it. This feature makes the present invention extremely advantageous in medical applications and in pneumatic sprayers, because of simplicity and low production costs.

The above and other objects and advantages of the present invention can be achieved in accordance with the following combination of its essential features, referring to different embodiments thereof.

The embodiments refer to a method for manufacturing of ultra-fine mono-disperse droplets, to an apparatus for implementing this method and to a mist, consisting of plurality of ultra-fine mono-disperse droplets, produced by the method.

In the main embodiment of the method are included the following steps: providing a porous partition, wetting one surface thereof by a liquid and passing a gas stream through the partition, wherein the gas stream is directed from dry surface of the partition to moistened surface of the partition and wherein the gas stream has dynamic pressure sufficient to overcome the hydraulic resistance of the partition moistened by the liquid.

In practice the basic parameters of the porous partition are:

Thickness 1.5–2.4 mm;

Typical pore size 0.2–2.0 $\mu$m;

Porosity 7–36%.

The partition can be made of metallic or non-metallic material, e.g. low-alloy steels, ceramics etc.

The gas suitable for the purpose of the invention should be filtered pressurized gas, e.g. nitrogen or air having minimum pressure 180 mbar. The gas flow rate determines the required sprayer capacity at given parameters of the partition. In accordance with the invention the gas stream should have dynamic pressure, which is sufficient to overcome the hydraulic resistance of the partition moistened by the liquid. In practice the required gas stream can be achieved by one of the following means:

Gas cylinders filled with nitrogen at 150–200 atm and supplying gas with the output temperature of 4–6° C.;

Powerful compressor capable to build pressure of 8 atm and to supply gas with the output temperature of 13–15° C.;

Piston-type pump

Low pressure centrifugal pump supplying gas with the output temperature of 50–78° C.;

Diaphragm-type pump supplying gas with the output temperature of 40–45° C.;

The suitable for the purpose of the invention liquid should be capable to wet the partition surface and to form thereon a uniform film with thickness 3–5 $\mu$m.

In practice any Newtonian liquid or suspensions having viscosity and surface tension comparable with those of water can be employed. Examples of suitable liquids or suspensions are water, water solutions of salt, sugar or other substances and suspensions thereof, alcohol, alcoholic solutions and suspensions thereof, petrol, kerosene, medical-purpose liquid preparations, chemical solutions and suspensions thereof.

The mist, obtained by virtue of the present invention is defined by the following parameters:

Droplets diameter, measured by particle size analysis, employing the Time of Transition Theory— about 0.5 $\mu$m; The Analyzer used for the measurement was CIS-100 Laser Analyzer, manufactured by Galai Production Ltd., Israel.

Droplets travel velocity—(1–15) cm/sec;

Droplets concentration in the mist—$(1–3)\times10^{12}$ $cm^{-3}$ (for mist prepared from water).

The present invention in its various embodiments has only been summarized briefly. For better understanding of the present invention as well of its advantages, reference will now be made to the following description of its embodiments with reference to the accompanying drawings.

DETAILED DESCRIPTION OF THE INVENTION

Figure 1:
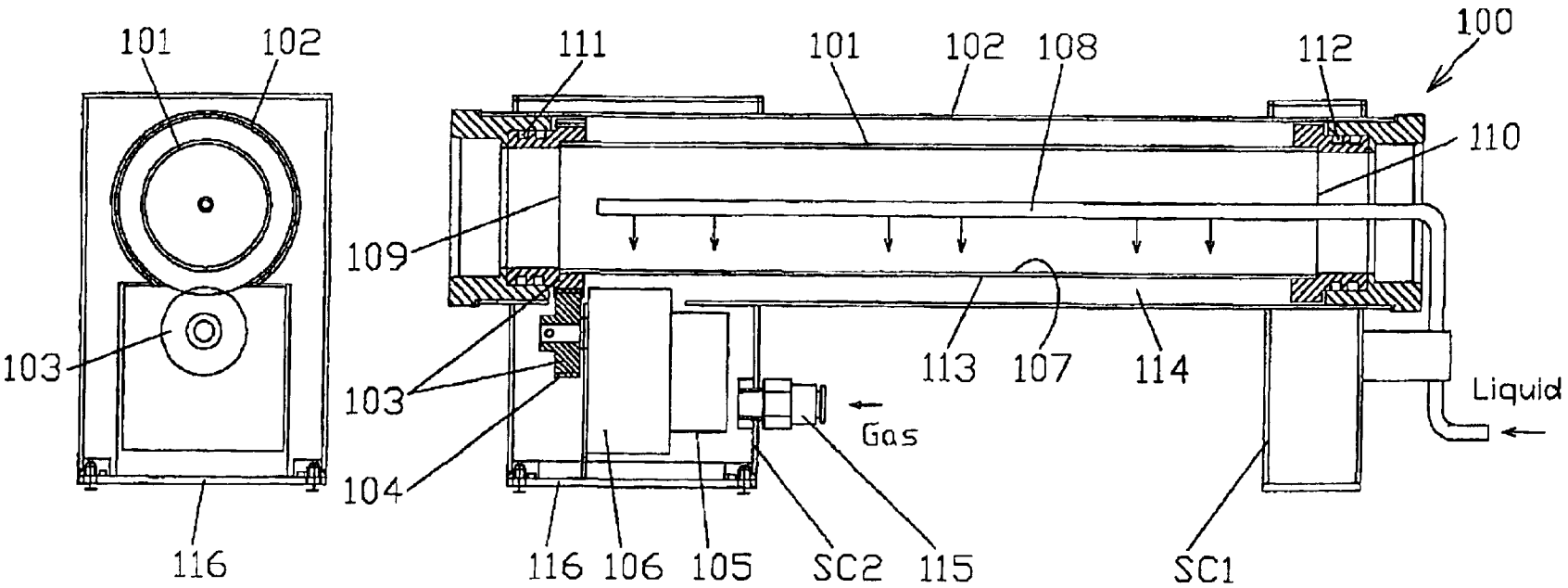
FIGS. 1–6 show various embodiments of the device for producing of ultra-fine droplets in accordance with the invention.

The invention is based on a very simple idea, which has been unexpectedly revealed to the applicant and confirmed empirically. In accordance with this idea if one side of a gas permeable wall is moistened by a film of liquid and if a gas stream is passed through the wall being directed from dry side of the wall to the wetted side then it is possible to spray the film in such a manner, that a plurality of very fine and mono-dispersed droplets of liquid emerge from the wetted side. The droplets emerge and move with low velocity and their amount is sufficient to form a cloud of mist, consisting of sprayed liquid.

Accordingly, the apparatus for producing the mist of the invention comprises a means for establishing a wall, or partition, at least a region thereof being gas-permeable, a means for wetting one side of the permeable region by a liquid and a means for passing through the permeable region of a gas stream, directed from the dry side of the region to the wetted side of the region. In practice a porous receptacle or a tube can be employed as suitable means for establishing the gas-permeable partition.

It is required also, that the wetting means is capable to create on one side of the region of a uniform thin film of minimal thickness. The excessive liquid should be removed. In practice the minimal film thickness depends on roughness of the partition surface and on such physical parameters of the liquid like surface tension and viscosity. The further pre-requisite for mist formation is a complete wetting of the gas-permeable region.

The wetting means include any suitable device, suitable to deliver liquid to the gas-permeable region. These can reside outside or inside the receptacle, or reside partially outside and partially inside thereof.

The means for delivering of the gas to the receptacle include any source of low-pressure gas. Since the mist is created at a certain combination of parameters of the gas-permeable region and of the gas pressure it would be advantageous if the apparatus is equipped with a means for measuring the pressure. In practice differential manometer can be employed for this purpose. By virtue of the invention the following advantages are achieved: by increasing the gas consumption over a given area of the gas-permeable region, we can increase the mist formation rate without deterioration of the droplets size distribution. This effect is attained regardless of the manner in which a liquid film on the surface of the gas-permeable region is created. Another advantage of this invention is that the amount of liquid delivered to the surface of the gas-permeable region need not be carefully monitored. At a one-time wetting, the mist formation process takes 2–2.5 minutes. The sprayed film can be restored, if the liquid is not fed continuously. As soon as the film covering any significant area of the porous surface is completely consumed during spraying, the mist formation gradually reduces to zero, provided that the gas flow rate remains unchanged. By increasing the gas flow rate, we can remove the film from the gas-permeable region. In such a case, the hydraulic resistance of the dry region remains the same as before wetting. This means that the mist formation will take place under the same conditions, as soon as the film is restored. This testifies to another advantage of the proposed invention: the gas-permeable region does not get clogged or blocked by liquid contaminants. Hence, the sprayer of the invention is not sensitive to the composition of the liquid to be sprayed.

Moreover, it has been discovered, that the proposed sprayer can be used not only for atomizing but also as a heat exchanger, if the spraying gas has an elevated temperature. In this case, apart from the mist formation, the reducing of temperature of the spraying gas takes place.

Another advantage of the proposed invention is that the sprayer can operate in cold premises (at temperatures lower than 0° C.), because atomization does not cause ice formation. This might be especially advantageous for use in containers for storing food.

The sprayer's operation as a heat exchanger is illustrated by the following experiment: air enters the sprayer at the flow rate of 3 $m^3$/hour at a temperature of 75° C. Afterwards, it leaves the sprayer at a temperature of 18° C., having sprayed 90 grams of water per hour. When air is fed at a temperature of 15.7° C., the temperature of the moistened gas-permeable region is 5.8° C., while adjacent to the sprayer the temperature is 7.7° C.

It is interesting to note that, with the lapse of time, the outside surface of the sprayer tank is cooled so that dew falls thereon. Gradually, it forms large drops that run down into the tray. Due to this effect, the proposed invention can be used to soften seawater.

Apparently, the sprayer can be fed with a heated gas. In this case, the sprayer will not only atomize the liquid and form ultra-fine droplets but also will simultaneously operate as a dryer. If the film comprises a suspension or solution the gas will dry the liquid from it, as the gas-liquid flow moves away from the film. The size of dried up particles will depend on their concentration in the suspension and it may be possible to obtain particulate material with particle size in the nano-range.

Now with reference to some non-limited examples below various embodiments of the invention will be described in more details. These embodiments are mainly distinguished by the manner in which a film on the gas-permeable region is created.

EXAMPLE 1

As seen in FIG. 1 a sprayer 100 is positioned horizontally and is formed as a double-wall tubular body, supported at both ends by supporting columns SC1 and SC2. The inner wall of the sprayer body comprises an internal porous gas-permeable cylinder 101 and the external wall of the body comprises an external gas-impermeable cylinder 102. The internal gas-permeable cylinder resides concentrically inside the external cylinder with possibility for rotation along its longitudinal axis. Rotation can be effected for example by virtue of a tooth wheel 103, rigidly secured on the internal cylinder. The tooth wheel interacts with a pinion 104, which is driven by a motor 105 through a set of pinions 106. An inner surface 107 of the internal cylinder is moistened by a liquid delivered thereto from an external source (not shown) via a perforated pipe 108, extending along the longitudinal axis of the internal cylinder. In order to wet the entire inner surface of the internal cylinder it is slowly rotated with a velocity of 0.5 rev/min. An excessively fast rotation reduces the amount of produced ultra-fine droplets and expands their particles size range. The liquid surplus can be drained from the porous cylinder through its open opposite sides 109,110. The minimum level of a liquid left within the porous cylinder will be determined by the position of scaling flanges 111,112, provided at the opposite ends of the cylinder and protruding within the interior of the porous cylinder by 0.5.–1 mm.

A gas, e.g. compressed air from an external source (not shown) is delivered to the outside surface 113 of the internal cylinder via a hollow space 114 between the internal and external cylinders. The gas is delivered through an inlet port 115 made in the left support column SC2. Attached to the bottom of column SC2 a flange 116 is provided to enable access to the column interior for maintenance.

When the gas enters the chamber SC2 it approaches the outer surface of the internal cylinder, passes through its permeable wall and then through the layer of liquid film covering the inner surface of the cylinder. The liquid film bubbles up, and the liquid surplus is discharged from the internal cylinder, provided that dynamic pressure of the gas supplied to the sprayer corresponds to hydraulic resistance of permeable wall and the film. To measure this pressure, the sprayer can be equipped with a manometer, a differential manometer, or any other pressure measurement means. The bubbling liquid remaining in the rotating internal cylinder assists to its homogeneous wetting and formation of thin film on its inner surface. Once the gas pressure in the sprayer exceeds a certain critical value, a dense mist is formed above the moistened surface of the internal cylinder. Such fog is completely non-transparent even for a highly focused ray of light.

Since the fog leaves the sprayer through its opposite open ends at low speed (equal at both ends), the created mist cloud resembles a cloud that forms over an open tank of boiling water. At a distance of some centimeters from the sprayer, the mist disappears in the atmosphere (if water was used as a moistening liquid).

The above-described sprayer has the following parameters:

| | |
|---|---|
| Porous cylinder material | stainless steel SS 316 |
| Porous cylinder dimensions, mm | Ø 50 × 500 |
| Typical pore size, μm | 0.5 |
| Maximal pore size, μm | 8.7 |
| Percentage of the open surface (approximate), % | 26 |
| Thickness of porous wall, mm | 1.57 |
| Thickness of water film, μm | about 3 |
| Air flow rate, $m^3$/h | 8.7 |

-continued

| | |
|---|---|
| Hydraulic resistance of moistened porous surface, mbar | 600 |
| Sprayer capacity, 1/h of water | 0.192 |
| Travel velocity of droplets emerging from inner cylinder surface, m/s | 0.02 |
| Travel velocity of droplets emerging from open ends, m/s | 0.6 |
| Droplets size, $\mu$m | 0.5 |

The capacity of the described-above sprayer was 70–192 grams of sprayed water per hour at airflow rate of 2.9–8.7 $m^3$/h. The air dynamic pressure was 470–600 mbar, which was sufficient to overcome hydraulic pressure of the cylinder wall coated by the film of liquid. If the airflow rate at the same cylinder dimensions is 1.5 $m^3$/h, then the mist formation process initiates at dynamic pressure of 180 mbar.

EXAMPLE 2

Figure 2:
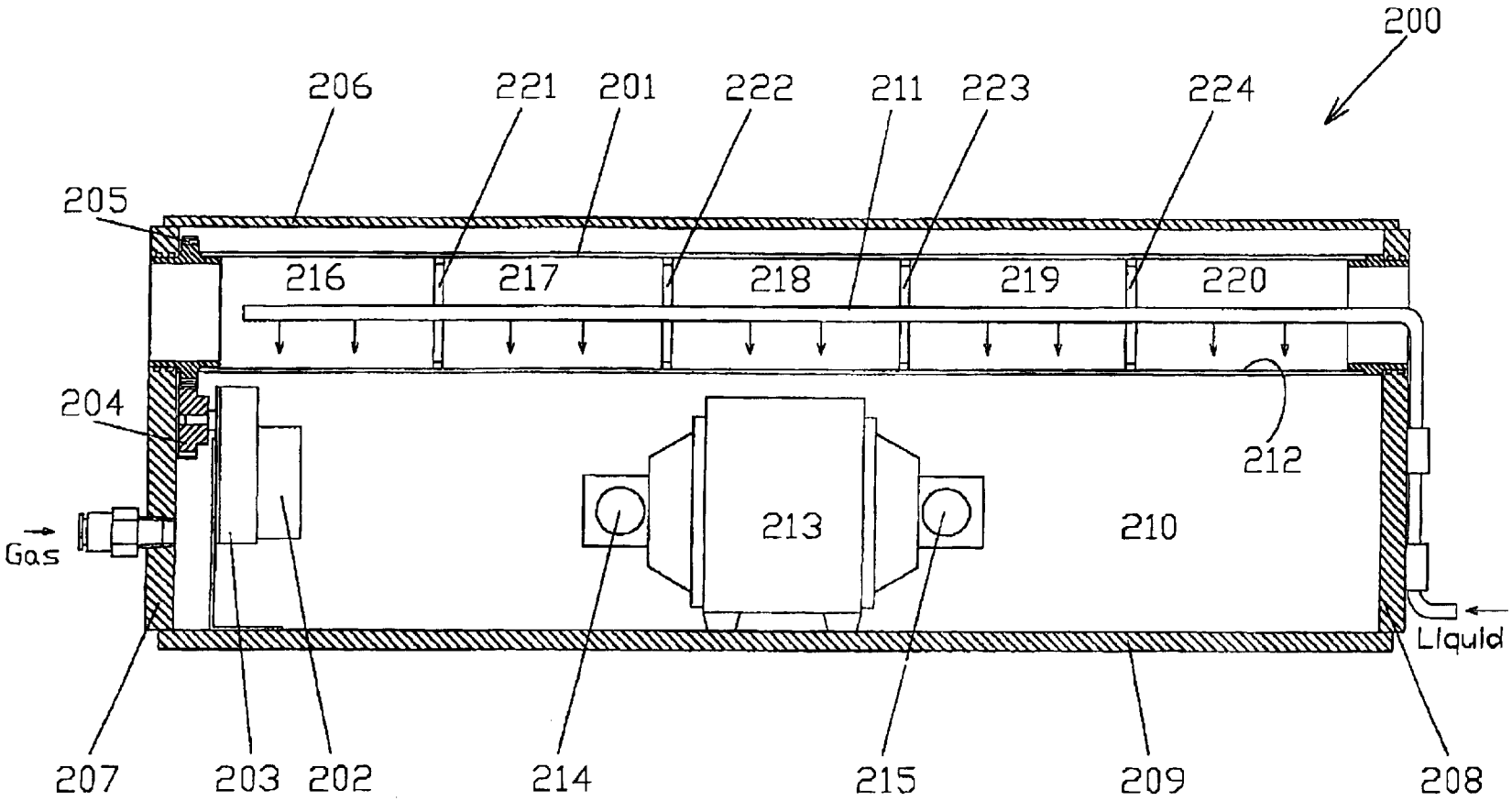

The sprayer in accordance with this embodiment is shown in FIG. 2. This embodiment is designated by numeral 200 and its configuration basically is similar to the embodiment designated by numeral 100, i.e. it includes permeable cylinder 201, disposed horizontally. The cylinder is secured with possibility for rotation along its longitudinal axis by virtue of a motor 202, a set 203 of pinions, a pinion 204 and a toothed wheel 205. The permeable cylinder resides in the upper part of an elongated housing, which is defined by an upper cover 206, by opposite lateral walls 207,208, by front and rear walls (not shown) and by a flat bottom 209. The permeable cylinder is mounted in the lateral walls of the housing with the aim of sealing flanges. A hollow space 210 is provided within the lower part of the housing under the permeable cylinder. A perforated pipe 211 delivers a liquid from an external source (not shown) to an inner surface 212 of the permeable cylinder. An air-pumping means 213 is provided, which is deployed in the hollow space of the housing. The hollow interior of the housing communicates with the outside space via openings 214,215, made in the front and rear walls to allow entrance of the outside air in the lower part of the housing. The air-pumping means is in communication with the openings made in the housing walls and thus it can take the air from outside and to let it in and then to force it through the cylindrical wall of the permeable cylinder. By virtue of this provision the whole sprayer in fact becomes a stand-alone unit, which does not require communication with a dedicate source of compressed air. Furthermore, the interior of permeable cylinder is divided into separate compartments 216,217,218,219,220 by a plurality of ring-like partitions 221,222,223,224 secured within the permeable cylinder at a certain distance from each other. The width of the ring determines the level of liquid remaining on the lower part of the inner surface of the permeable cylinder. Taking this into consideration the width of each ring-like partition is selected in such a manner, that in a case when the sprayer is inclined at a certain angle to the horizon, there will be enough liquid remaining within each section to cover the entire length of the inner surface. Then, the porous inner surface of each compartment will be moistened when the porous cylinder rotates. This embodiment is preferable, when the sprayer is used on a sea vessel in stormy weather (a strong bumpiness), or in an aircraft during take-off, climbing and landing, or in other applications associated with inclination.

The sprayer performance and the mist parameters were similar to those described in Example 1.

EXAMPLE 3

Figure 3:
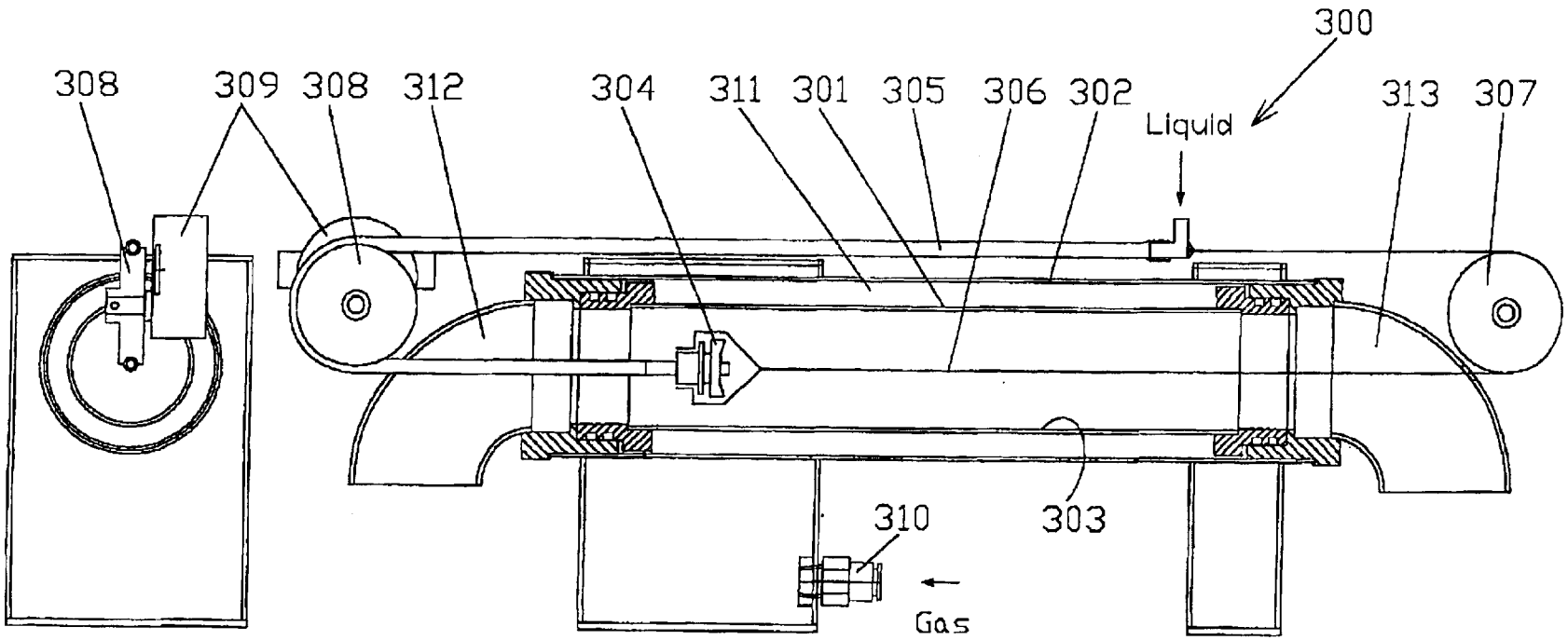

With reference to FIG. 3 the sprayer 300 according to this embodiment consist essentially of the same elements and has the same configuration as the sprayer disclosed in Example 1. It can be seen, that the sprayer is directed horizontally and is supported by supporting columns. Compressed gas is delivered to the sprayer via inlet port provided in one of the columns. The sprayer comprises an internal permeable cylinder 301, which is disposed within and co-axially with an external impermeable cylinder 302. However in contrast to the previous embodiments here the internal porous cylinder is rigidly secured within the external cylinder and therefore does not rotate. An inner surface 303 of the porous cylinder is moistened by virtue of a sprinkle means 304, which is formed as rotating disk, provided with tangentially disposed nozzles to which a liquid is delivered from an external source (not shown) via a tube 305, made of elastic material. The sprinkle means is connected to one end of a string 306 drawn between couple of rollers 307,308. The string can be wound into or unwound from the roller 307. The second end of the string is connected to the tube, which can be wound into or unwound from the roller 308. Operatively connected to the roller 308 a motor 309 is provided, which rotates the roller clockwise or anticlockwise. By virtue of this provision the sprinkler means can be pulled back and forth along the interior of the porous cylinder. It can be readily appreciated, that in this embodiment moistening of the entire inner surface of the internal cylinder is achieved due to jets of liquid emerging from the nozzles and due to the linear displacement of the disk along the porous cylinder. A mist consisting of tiny mono-disperse droplets of liquid is formed when a gas is supplied through an inlet port 310 to a hollow space 311 between the cylinders. The open opposite sides of the internal cylinder communicate with corresponding bent outlet ports 312,313, which direct the mist emerging from the porous cylinder. In FIG. 3 the ports are bent downwardly, however should these pipes be directed upward, there is no need for the ring partitions, as described in Example 2. Besides, the outlet ports prevent casual discharge of large drops of bubbling liquid from the porous cylinder by the gas flow. Moreover, the described arrangement of the outlet ports ensures a stand-alone operation of the sprayer for 30–60 minutes without forcible wetting of the inner surface of the porous cylinder. Consequently, the previous and subsequent embodiments can be equipped with similar outlet ports.

The sprayer performance and the mist parameters were similar to those described in Example 1.

EXAMPLE 4

Figure 4:
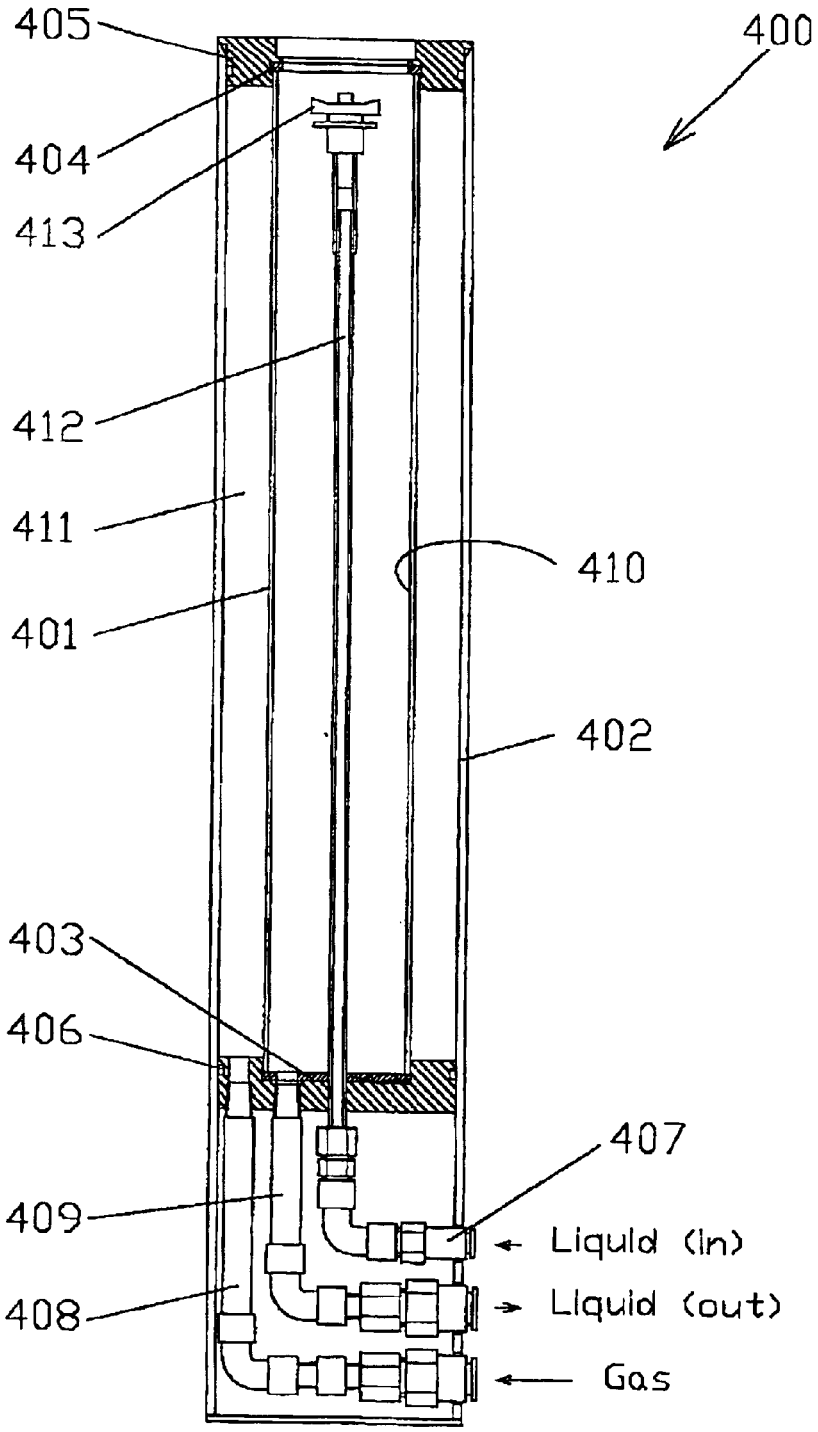

This embodiment is shown in FIG. 4 and it represents the simplest and cheapest option of the apparatus of the invention.

The sprayer 400 has a vertical configuration. The apparatus consists of an inner permeable cylinder 401 disposed within and coaxially with an external impermeable cylinder 402. The internal cylinder is provided with a bottom flange 403 and has an open upper end 404. The internal cylinder is secured within the external cylinder by virtue of an upper flange 405 and a lower flange 406. In the lower part of the external cylinder are provided ports and conduits 407,408, 409. The purpose of the ports is correspondingly delivering of a wetting liquid, delivering a gas into a hollow space 411 between the internal and external cylinder and evacuation of excessive liquid from the internal cylinder. Secured on the top of a rigid support tube 412 a sprinkle means 413 is provided for wetting the inner surface 410 of the internal cylinder. The support tube is connected to port 407 and thus the wetting liquid can be supplied to the sprinkle means. As in the previous embodiment the sprinkle means comprises a disk equipped with tangential nozzles, through which the liquid emerges and creates jets rotating the disk. Since the disk is disposed in the upper part of the internal cylinder the liquid flows down by gravitation and wets the entire inner surface. The excessive liquid is evacuated from the internal cylinder through the bottom flange and port 409.

The gas enters the hollow space 411 via port 408 and lower flange 406. Appropriate ring seals are provided between flanges 405,406 and the outer cylinder to ensure that the gas does not escape the hollow space. In domestic applications of the sprayer a lighting device for producing light effect can be provided.

In this embodiment, the velocity of droplets emerging from the open upper end of the sprayer was twice as high as in the previous embodiments. The basic mist parameters were identical to those in Example 1. It was possible to increase the sprayer capacity by a short-term (about 2 minutes) pause of liquid delivery to the disk.

EXAMPLE 5

Figure 5:
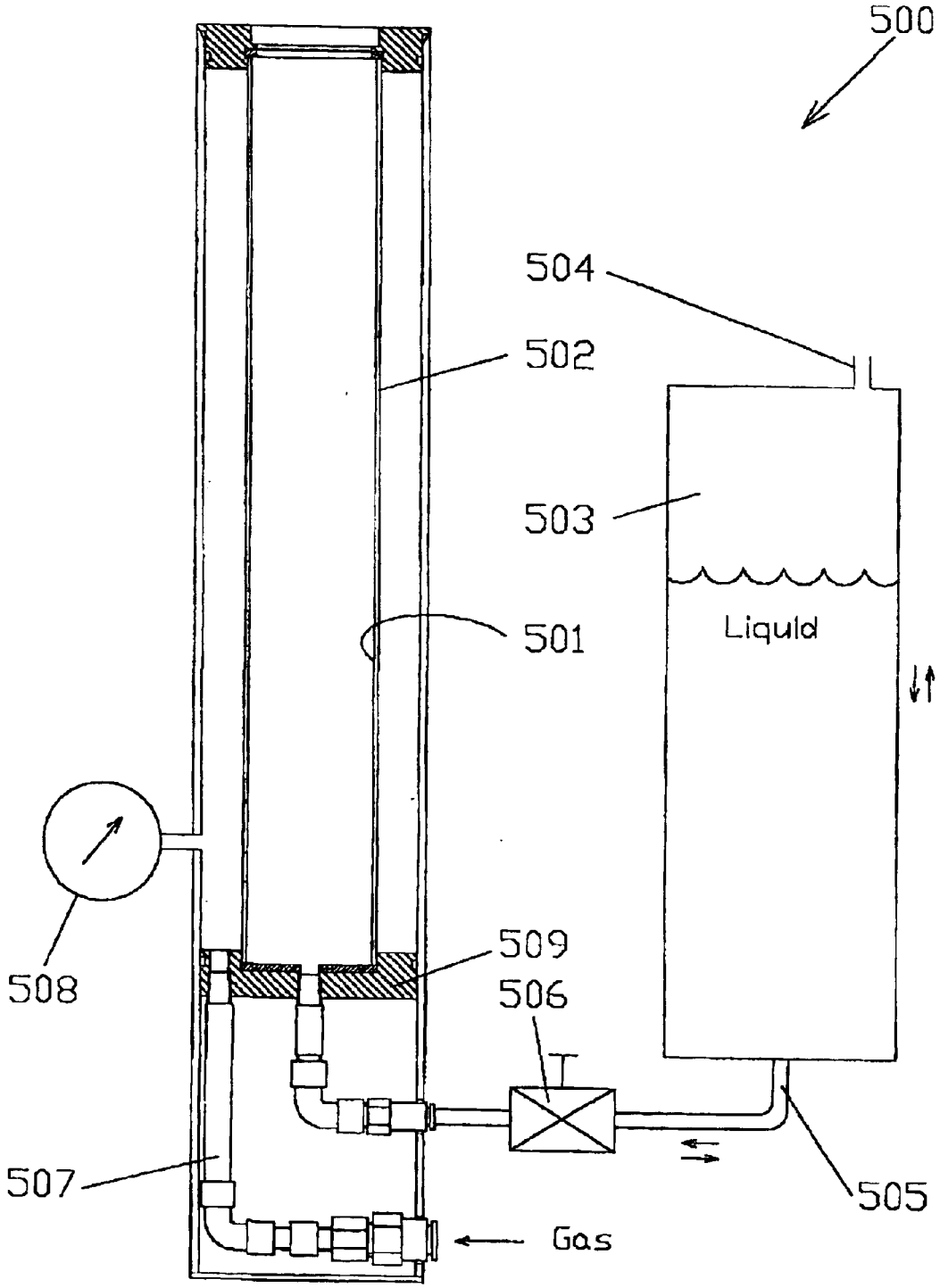

In this embodiment shown in FIG. 5 a sprayer 500 is used as a manual inhaler for the delivery of drugs to the respiratory tract.

The construction of this embodiment basically is similar to the previous example 4, however there is no rotating disk. An inner surface 501 of an internal porous cylinder 502 is moistened by a relative displacement of the internal cylinder and a vessel 503 filled with a wetting liquid and communicating with the cylinder. The vessel is open to the atmosphere by virtue of an opening 504 made in its upper part and thus it can communicate with the cylinder according to the physical principle of interconnecting containers. Lifting and lowering the vessel can attain wetting, for example. The vessel is to be lifted at a certain height, so that the level of liquid within the vessel corresponds to about ⅔ of the height of the porous cylinder. The remaining ⅓ of the cylinder's height is moistened spontaneously due to elevation of the wetting liquid boiling therein, once a gas passes through the wall of the internal cylinder. The vessel is to be lowered so that the liquid is at the level of a lower flange 509 or lower. The vessel communicates with the internal cylinder via a flexible tube 505, which can be closed or opened by a tap 506.

After a one-time lifting and subsequent lowering of the vessel, the mist formation process can last for some minutes. The amount of sprayed liquid depends on the area of the internal porous cylinder and on gas flow rate. The gas can be delivered to the sprayer via a conduit 507 from a compressed air cylinder, which can be integrated in the inhaler.

It can be readily appreciated, that since the velocity of mist droplets is low, the mist can be directed to the mouth by inhaling. Due to the small sizes of sprayed droplets, these can reach the bottom of the bronchi and produce therapeutic effect.

A manometer 508 measures the pressure drop during mist formation and monitors the permeability of the internal cylinder before repeated inhalation. When the treatment session ends, the tap is closed, and the porous cylinder is rinsed with clean water. The porous cylinder is then dried by a short-term passage of gas through it. Then, the inhaler is ready for further operation.

It should be appreciated that the present invention is not limited by the above-described embodiments and that one ordinarily skilled in the art can make changes and modifications without deviation from the scope of the invention.

For example, for moistening of the porous cylinder one can use alternative measures, like one-time immersion of the internal cylinder, or the whole apparatus into a bath, filled with the wetting liquid. The immersion might be accompanied by rotation. The direction of immersion can be either horizontal or vertical; Moistening can be carried out by repeating immersion of the device into a bath followed by removal and the discharge of liquid surplus; Moistening can be carried out by a jet of liquid directed to the porous surface;

Alternative types of sprayers can be contemplated, in which instead of cylindrical porous partition a cup-like porous partition or a flat porous partition is employed.

Figure 6:
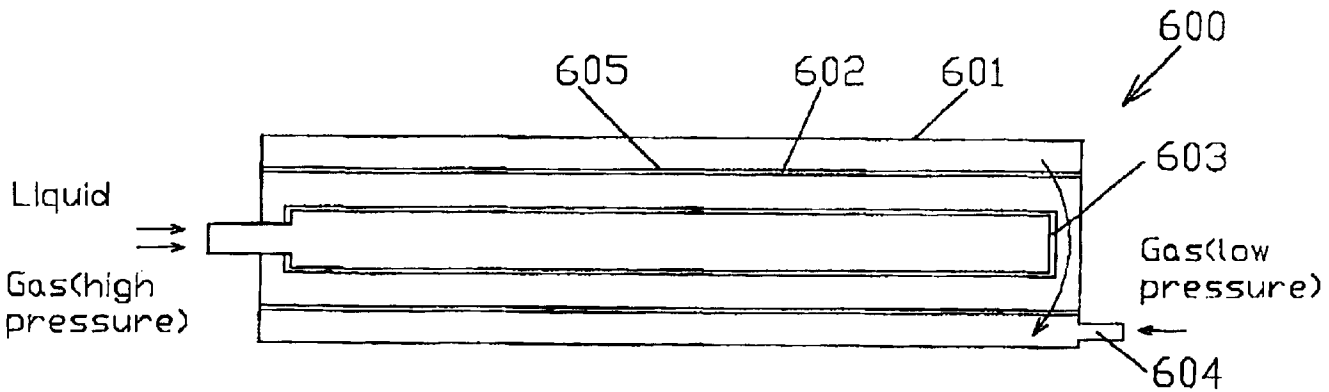

In FIG. 6 is schematically shown an embodiment, employing atomizing method of the present invention. According to this embodiment a sprayer 600 is configured as an impermeable cylindrical housing 601, in which resides an internal permeable cylinder 602. The internal cylinder is mounted within the housing with possibility for rotation by a drive means, which is not shown. Protruding inside the internal cylinder and closed from one end an elongated porous tube 603 is provided. A gas under pressure $P_1$ is fed inside the internal cylinder simultaneously with a wetting liquid via porous tube 603. The housing is provided with an inlet port 604 for delivering a gas under pressure $P_2$ to the outside surface 605 of the internal cylinder.

In practice, the pressure $P_1$ should be higher than pressure $P_2$ due to higher hydraulic resistance associated with the passing of liquid (more viscous than gas) through the pores of the porous tube. The porosity and thickness of the tube can be identical to or different from those of the rotating porous cylinder. The principle of operation of the sprayer referring to this embodiment is similar to those described in the previous examples. In this embodiment the velocity of droplets emerging from the open ends of the internal cylinder may be somewhat higher than in the previous sprayers.

By virtue of the present invention a mist, consisting of extremely small droplets, having very narrow size distribution and moving with very low velocity can be produced. A sprayer, having very simple construction and reliable performance, can produce such a mist on a large scale. The sprayer in its various embodiments can be employed in various industrial applications, in which it is required or desirable to employ such a mist. Short list of possible industrial applications includes: air humidifying and cooling, inhalation in medicine, softening of sea water, heat exchange, producing of nano-size powders, crystallization and catalysis in chemical and food-processing industries, fuel spraying, applying of extremely thin coatings, printing, smoking of food products, etc.

It should also be appreciated that features disclosed in the foregoing description, and/or in the foregoing drawings, and/or examples, and/or following claims both separately and in any combination thereof, be material for realizing the present invention in diverse forms thereof.

What is claimed is:

1. A method for formation of a mist consisting of ultrafine droplets, said method comprising the steps of:

a) providing a partition, made of a rigid material, at least a region thereof being gas permeable, said region is defined by a first and by a second surface and by a bulk portion confined therebetween, b) moistening the first surface of the region by a liquid to form a film of the liquid, said film coating the first surface of the region, while leaving dry the second surface of the region and the bulk portion thereof, c) establishing a stream of gas directed from the second surface to the first surface of the region, wherein said gas stream is capable to pass the bulk portion of the gas-permeable region and to convert the film covering the first surface into a mist consisting of plurality of discrete droplets, said droplets emerging from the first surface of the gas permeable region.

2. The method as defined in claim 1, in which said gas-permeable region has open porosity 7–36%, said film has thickness 3–5 $\mu$m and said gas stream is passed at a pressure of at least 180 mbar and with a flow rate of at least 1.5 $m^3$/h.

3. The method as defined in claim 2, in which said gas is selected from the group consisting of air, nitrogen, carbon oxide, oxygen, ozone, inert gas and their combination.

4. The method as defined in claim 3 in which said liquid is selected from the group consisting of mono-phase liquid, solution, emulsion and suspension.

5. The method as defined in claim 3, in which said liquid is selected from the group consisting of an organic liquid, an inorganic liquid and their combination.

6. The method as defined in claim 5, in which said organic liquid is selected from the group consisting of alcohol, kerosene, oil and a liquid medication.

7. The method as defined in claim 6, in which said inorganic liquid is water.

8. The method as defined in claim 4, in which said gas is air, said liquid is water and said gas stream is passed at pressure 470–600 mbar and with flow rate 2.9–8.7 $m^3$/h.

9. An apparatus for formation of a mist consisting of ultra-fine droplets, said apparatus comprises:

a) a partition made of a rigid meterial, at least a region thereof being gas-permeable, said region is defined by a first and by a second surface and by a bulk portion confined therebetween, b) a liquid discharge device capable of moistening the first surface of the gas-permeable region by a liquid to form a film of the liquid on the first surface c) a means for establishing a gas stream directed from the second surface of the gas-permeable region to the first surface thereof wherein said gas stream is capable to pass the bulk portion of the gas-permeable region and to convert the film covering the first surface into a mist consisting of plurality of discrete droplets which emerge from the first surface of the gas-permeable region.

10. The apparatus as defined in claim 9, in which said partition comprises a gas-permeable cylinder, which is made of metallic material with open porosity 26% and pore size 0.5–8.7 microns, said cylinder is disposed within a gas-impermeable cylindrical housing.

11. The apparatus as defined in claim 10, in which said gas-permeable cylinder is mounted with possibility for rotation along its longitudinal axis within the housing, said liquid discharge device comprises a perforated pipe, extending along the cylinder and delivering the liquid phase from an external source to the inner surface of the gas-permeable cylinder.

12. The apparatus as defined in claim 9, in which said means for establishing the gas stream comprises a gas cylinder or a pump.

13. The apparatus as defined in claim 9, in which said means for establishing the gas stream comprises a pump, residing within a housing, said pump is in communication with outside atmosphere.

14. The apparatus as defined in claim 10, in which said gas-permeable cylinder is rigidly secured within the housing and said liquid discharge device comprises a rotating sprinkle means, linearly displaceable within the gas-permeable cylinder and said apparatus comprises a displacing mechanism for displacing the sprinkle means.

15. The apparatus as defined in claim 10, in which said gas-permeable cylinder is directed horizontally.

16. The apparatus as defined in claim 10, in which said gas-permeable cylinder is directed vertically, wherein said liquid discharge device comprises a rotating sprinkle means located in the upper part of the gas-permeable cylinder and said sprinkle means is rigidly secured on a hollow support, which communicates with the means for establishing the gas stream.

17. The apparatus as defined in claim 10, in which said liquid discharge device comprises a vessel, filled with the liquid phase and said vessel is in communication with the gas-permeable cylinder.

18. The apparatus as defined in claim 17, in which said liquid phase is a medication.

19. A mist, produced by the method of claim 1, said mist consisting of liquid droplets, which diameter is about 0.5 microns, said droplets drifting with velocity of 1–15 cm/sec.

20. The mist as defined in claim 19, in which said liquid is water and concentration of droplets in the mist is at least $1\times10^{12}$ $cm^{-3}$.

* * * * *